US007479865B2

(12) United States Patent
Feist et al.

(10) Patent No.: US 7,479,865 B2
(45) Date of Patent: Jan. 20, 2009

(54) MOUNTING DEVICE, SUPPORT DEVICE FOR A TOROIDAL CORE CHOKE, AND INDUCTIVE COMPONENT

(75) Inventors: Guenter Feist, Gingen/Fils (DE); Karl Niklas, Koenigsbronn-Itzelberg (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 11/957,185

(22) Filed: Dec. 14, 2007

(65) Prior Publication Data

US 2008/0117009 A1 May 22, 2008

Related U.S. Application Data

(63) Continuation of application No. PCT/DE2006/000933, filed on May 31, 2006.

(30) Foreign Application Priority Data

Jun. 16, 2005 (DE) ..... 10 2005 027 942

(51) Int. Cl.
*H01F 27/28* (2006.01)

(52) U.S. Cl. ..... 336/229

(58) Field of Classification Search ..... 336/65, 336/68, 83, 225, 229
See application file for complete search history.

(56) References Cited

U.S. PATENT DOCUMENTS

| | | | | |
|---|---|---|---|---|
| 4,821,152 | A | 4/1989 | Lorenzen | |
| 7,280,027 | B2 | 10/2007 | Feth et al. | |
| 7,400,224 | B2 * | 7/2008 | Feist | 336/229 |
| 2007/0241855 | A1 | 10/2007 | Feist | |

FOREIGN PATENT DOCUMENTS

| | | | | |
|---|---|---|---|---|
| DE | 30 47 603 | A1 | | 7/1982 |
| DE | 43 21 872 | A1 | | 2/1995 |
| DE | 102 23 995 | C1 | | 11/2003 |
| DE | 103 08 010 | A1 | | 9/2004 |
| DE | 10 2004 048 966 | A1 | | 4/2006 |
| GB | 2 288 493 | A | | 10/1995 |
| JP | 07045444 | A | * | 2/1995 |
| JP | 2000228310 | A | * | 8/2000 |

* cited by examiner

*Primary Examiner*—Tuyen T. Nguyen
(74) *Attorney, Agent, or Firm*—Slater & Matsil, L.L.P.

(57) ABSTRACT

A mounting device for a toroidal core, preferably insertable into a toroidal core, has a catch device and thus fixable on a counterpart, as well as a support device for a toroidal core choke. The support device has at least one catch device on which mounting device can be fixed.

32 Claims, 6 Drawing Sheets

MOUNTING DEVICE, SUPPORT DEVICE FOR A TOROIDAL CORE CHOKE, AND INDUCTIVE COMPONENT

This application is a continuation of co-pending International Application No. PCT/DE2006/000933, filed May 31, 2006, which designated the United States and was not published in English, and which is based on German Application No. 10 2005 027 942.2 filed Jun. 16, 2005, both of which applications are incorporated herein by reference.

TECHNICAL FIELD

A mounting device and a mount as well as a support device fixed thereon for a toroidal core choke are described. In addition, an inductive component with the mounting device is described.

BACKGROUND

An insulating component is known from, e.g., the publication of German patent application DE 10223995 C1. That insulating component surrounds the toroidal core of a toroidal core choke and has projections for fixing wire windings as well as for maintaining a pattern. In its center area, the insulating component has webs, which provide for potential separation.

Another insulating component is known, e.g., from the publication of German patent application DE 10308010 A1 and corresponding U.S. Pat. No. 7,280,027. The insulating component has webs running radially outwards, which are elastically deformable in the radial direction under pressure.

SUMMARY OF THE INVENTION

In various embodiments, the present invention solves a problem of specifying a mount for a toroidal core choke with several windings to be insulated from one another.

In accordance with a first embodiment, a mounting device insertable in a toroidal core is specified. The mounting device comprises catch devices and can be fixed by means of these catch devices to a counterpart. A casing, a partial housing or a support device can serve as a counterpart, for instance.

A support device for a toroidal core, which comprises a catch device for fixing a mounting device for the toroidal core, is additionally specified.

Preferred configurations of the specified mounting and support devices are described below.

The mounting device can preferably be fixed in the toroidal core hole by means of flexural forces.

The mounting device and the support device are advantageously each formed from an electrically insulating material. Plastics suitable for injection molding are particularly worthy of consideration.

In an advantageous variant, the specified support device and the specified mounting device form a mount or a partial housing for an inductive component with a toroidal core choke, wherein the catch devices of the mounting device and of the support device are formed complementarily to one another.

It is additionally possible to fix the mounting device in a casing or partial housing, which has catch devices provided for this purpose.

The catch device of a mounting device or a support device is preferably designed as a catch surface. The catch surface can, for instance, be ribbed.

The catch devices are preferably arranged on both faces of the mounting device. The part of the mounting device bearing the catch devices is preferably constructed to protrude in relation to the remaining parts of the mounting device.

The mounting device can be provided as a potential separation device, for instance, for a toroidal core choke with several windings. For example, it can have a star-shaped arrangement of several webs, at least one of the webs having a catch device, preferably a catch surface.

In a preferred embodiment, the mounting device comprises a center section and at least two elastically deformable webs running outwards that can be wound around the center section, each having a fixed insulating area at its end facing away from the center section.

In one embodiment, a catch device is arranged on the fixed insulating area. Preferably at least one catch surface is arranged on each side of each insulating area. Alternatively, a catch device can be arranged at the center section, preferably also on the front side.

The catch device of the support device can comprise two mutually opposing catch surfaces. The mounting device for a toroidal core is preferably fixed between these catch surfaces.

A preferred embodiment of a support device is additionally described. The support device comprises a base plate, which has projecting, elongated fixing devices and an area arranged between them for accommodating a toroidal core choke. The fixing devices extend preferably perpendicularly to the base plate and have the form of a bar.

A toroidal core choke in one variant is preferably arranged upright between two fixing devices opposing one another in a transverse direction.

A fixing device has at least one catch device, preferably a catch surface, facing the choke area. Fixing devices can have elongated projections that limit the catch surface laterally. The ends of the projections turned away from the base plate are preferably beveled.

In an advantageous variant, the fixing devices are also provided for guiding the wires or maintaining the pattern of a wire winding for the toroidal core choke. They each preferably comprise at least one wire guide channel that runs parallel to the axis of the fixing device or perpendicular to the base plate. The ends of one of the wire windings are led in the wire guide channels of the fixing devices. A wire guide channel is preferably formed as a groove on the side of the fixing device turned away from the choke area.

A fixing device is thus preferably used for several purposes, i.e., both for the fixing of the mounting device and for wire guidance. A multi-functional fixing device preferably has an H-profile.

In the base plate, preferably at least two wire guide openings are provided for the accommodation of ends of a wire winding. The wire guide channel of a mounting device issues into one of these openings.

BRIEF DESCRIPTION OF THE DRAWINGS

Various embodiments of a mounting device, a support device, a mount for an inductive component and an inductive component will be described in detail below on the basis of schematic figures not drawn to scale. Shown are.

Figure 1:
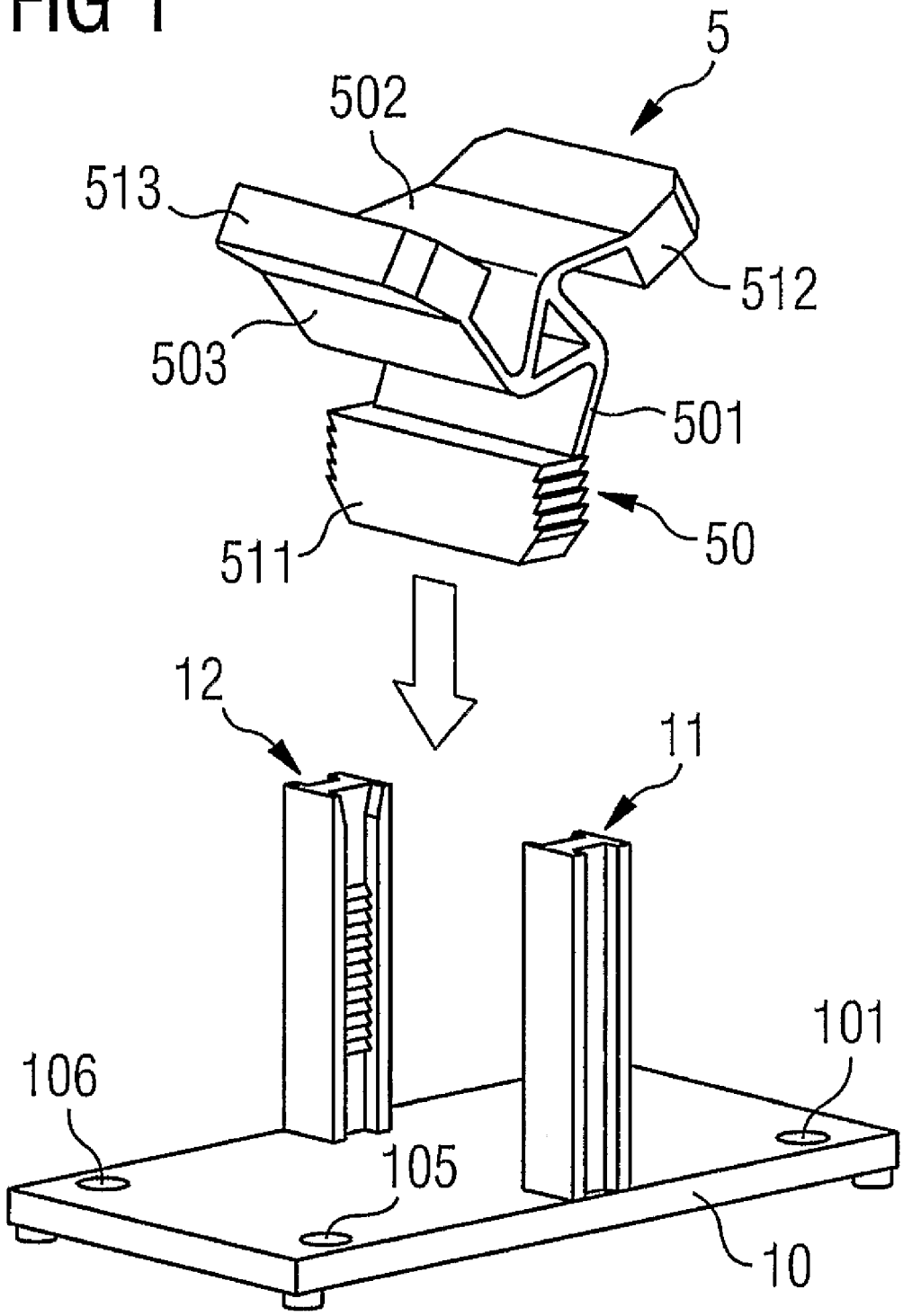
FIG. 1, in a perspective view, a mounting arrangement for an inductive component: the support device according to FIGS. 4 to 6 with catch devices (below) and a mounting device according to FIG. 3 with an opposite pattern, designed as a potential separation device, (above)

The following list of reference numbers can be used in conjunction with the figures.

10 Base plate
101-106 Pattern openings
11, 12 Fixing devices
111, 112, 121, 122 Projections
111*a*, 121*a* Beveled surfaces
113, 123 Catch device
2 Toroidal core
31, 32, 33 Ends of the wire windings
41, 42, 43 Wire windings
5 Potential separation device
50 Catch surface
501, 502, 503 Deformable webs
511, 512, 513 Insulating areas
521, 522, 523 Webs
55 Center section of the potential separation device

DETAILED DESCRIPTION OF ILLUSTRATIVE EMBODIMENTS

Figure 2:
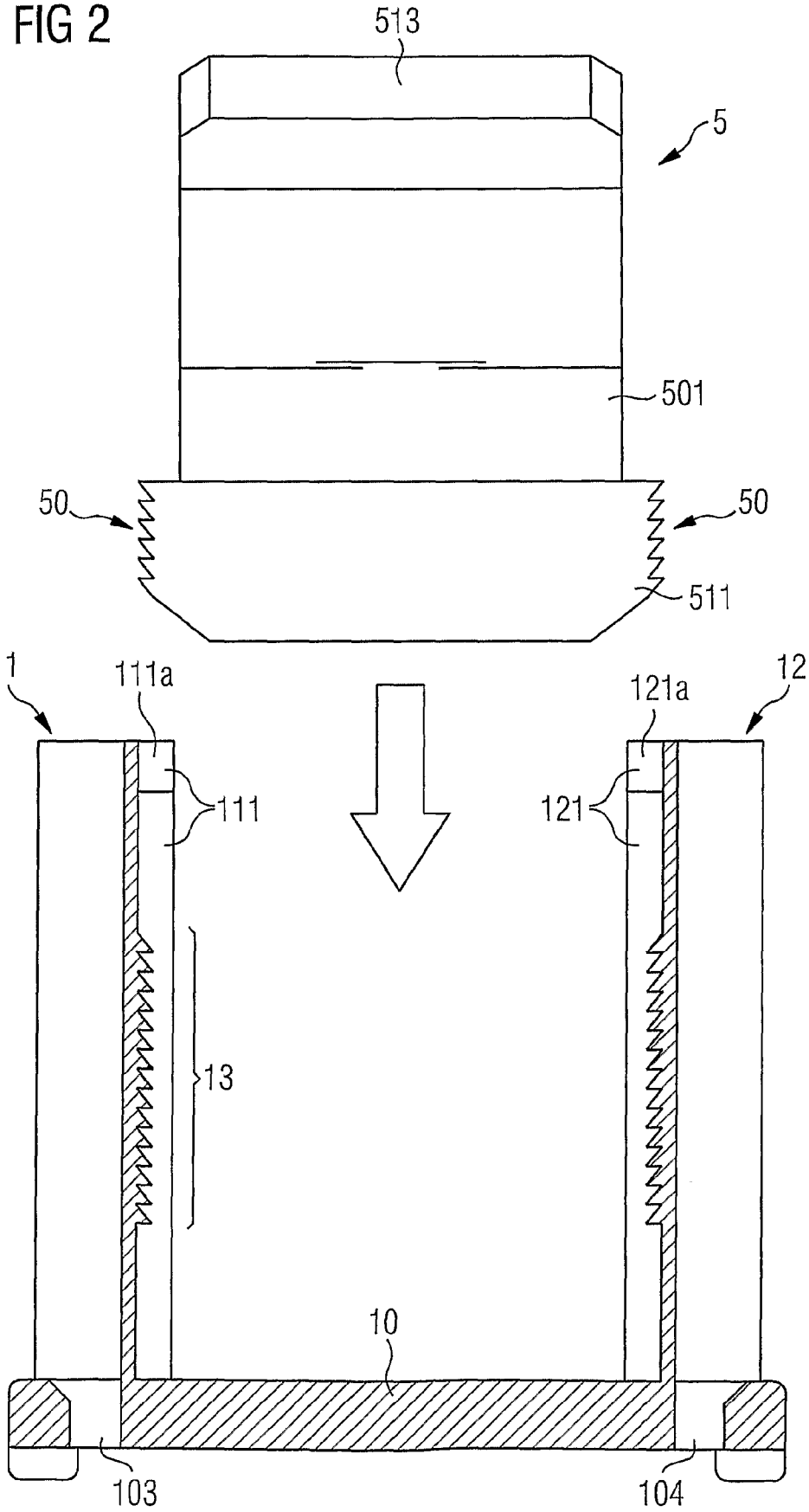
FIG. 2, the mounting device according to FIG. 1 in a partial cross-sectional view before insertion of the potential separation device into the support device.

FIG. 1 shows a mount for an inductive component with a mounting device formed as a potential separation device 5 (above) and a support device also explained in the description of FIGS. 4 to 6 (below). FIG. 2 shows the mount in FIG. 1 in another view.

Figure 3:
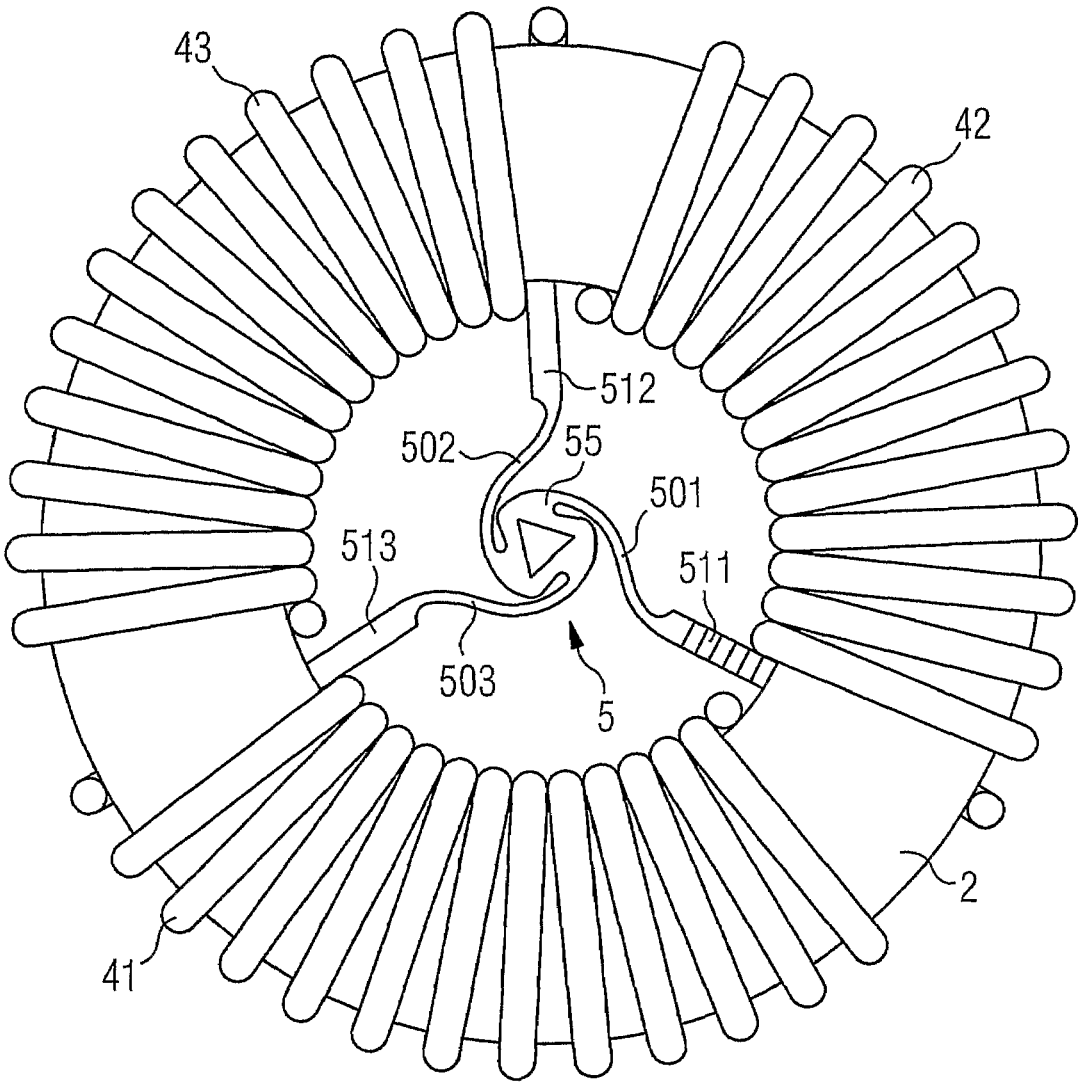
FIG. 3, a plan view onto the top side of a toroidal core choke with a potential separation device inserted into the core hole.

A potential separation device 5 inserted into the core hole of toroidal core 2 of a toroidal core choke is shown in FIG. 3. Potential separation device 5 serves as a spacer between wire windings 41, 42, 43 of the toroidal core choke.

Any mounting device for a toroidal core can have the below-described features of a potential separation device 5.

Figure 9:
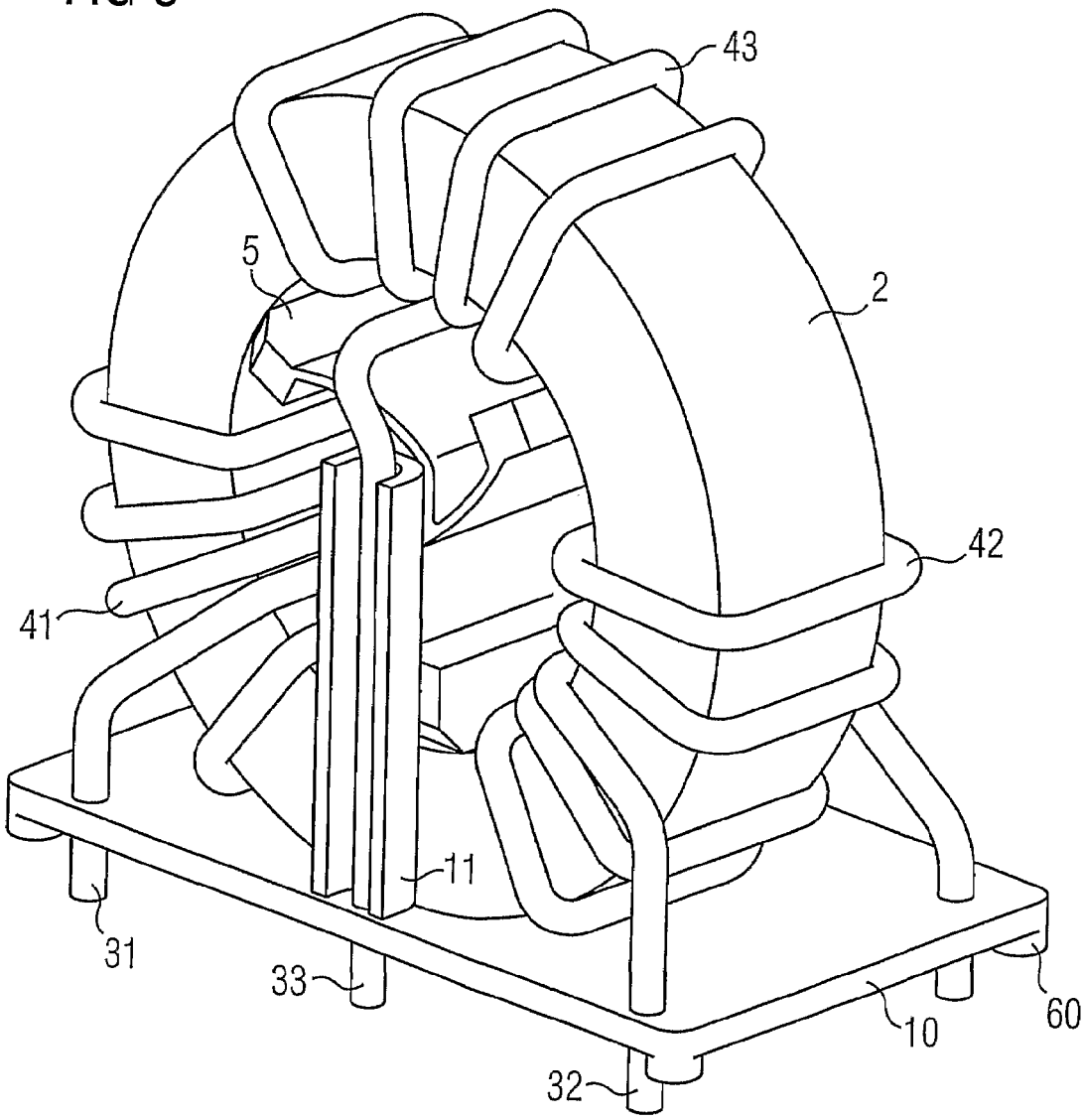
FIG. 9, an inductive component with a mount for a toroidal core choke according to FIG. 1.

The toroidal core choke that can be seen in FIG. 9 comprises a toroidal core 2 and three wire windings 41, 42, 43, wound onto this core, each at its own electrical potential.

Potential separation device 5 is preferably fixed in the core hole by means of elastic forces acting in the radial direction.

Potential separation device 5 according to FIGS. 1 and 3 comprises a center section 55 as well as three webs 501, 502, 503, elastically deformable in this variant, running outward from it in a star shape, at the ends of which facing away from the center are provided insulating areas 511, 512, 513.

Figure 7:
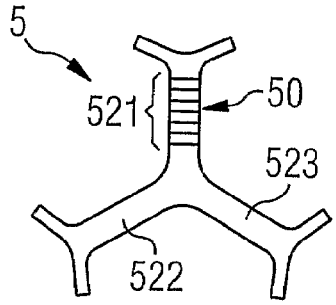
FIGS. 7 and 8, different views of an additional potential separation device with star shaped webs and a catch device.
Figure 8:
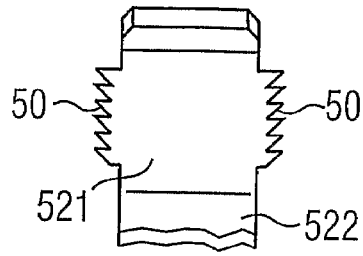

Webs 521, 522, 523 of a potential separation device 5 shown for the sake of example in FIGS. 7 and 8 can be rigid in an additional variant and have, at their ends turned towards the toroidal core, elastically deformable, preferably spreadable devices, which press against the inner wall of the core hole when potential separation device 5 is pushed into a core hole. Webs 521, 522, 523 are arranged in a star shape.

It is indicated with a broad arrow in FIGS. 1 and 2 that potential separation device 5, preferably after insertion into the core hole of a toroidal core, is pushed between fixing devices 11 and 12 and fixed between them in the vertical direction by means of catch devices 50, 113 as well as in the longitudinal direction by means of projections 111, 112 and 121, 122 of fixing devices 11, 12.

On both faces of fixed insulating area 511, catch devices 50 are formed in a ribbed shape. Fixed insulating area 511, i.e., the part of potential separation device 5 bearing catch devices 50, projects axially on both sides past the other parts of the potential separation device. The axial size of the remaining parts of the potential separation device is preferably matched to the axial size of the toroidal core, with insulating area 511 protruding on both sides of the core and thus suitable for fixation of the arrangement consisting of potential separation device 5 and core 2.

Only one respective projection 111, 121 of fixing device 11 and 12 is visible in FIG. 2. An upper end of projection 111, 121 has a slanted surface 111*a*, 121*a*, respectively. Slanted surfaces of the projections associated with a given fixing device face one another, see FIG. 4.

Figure 2A:
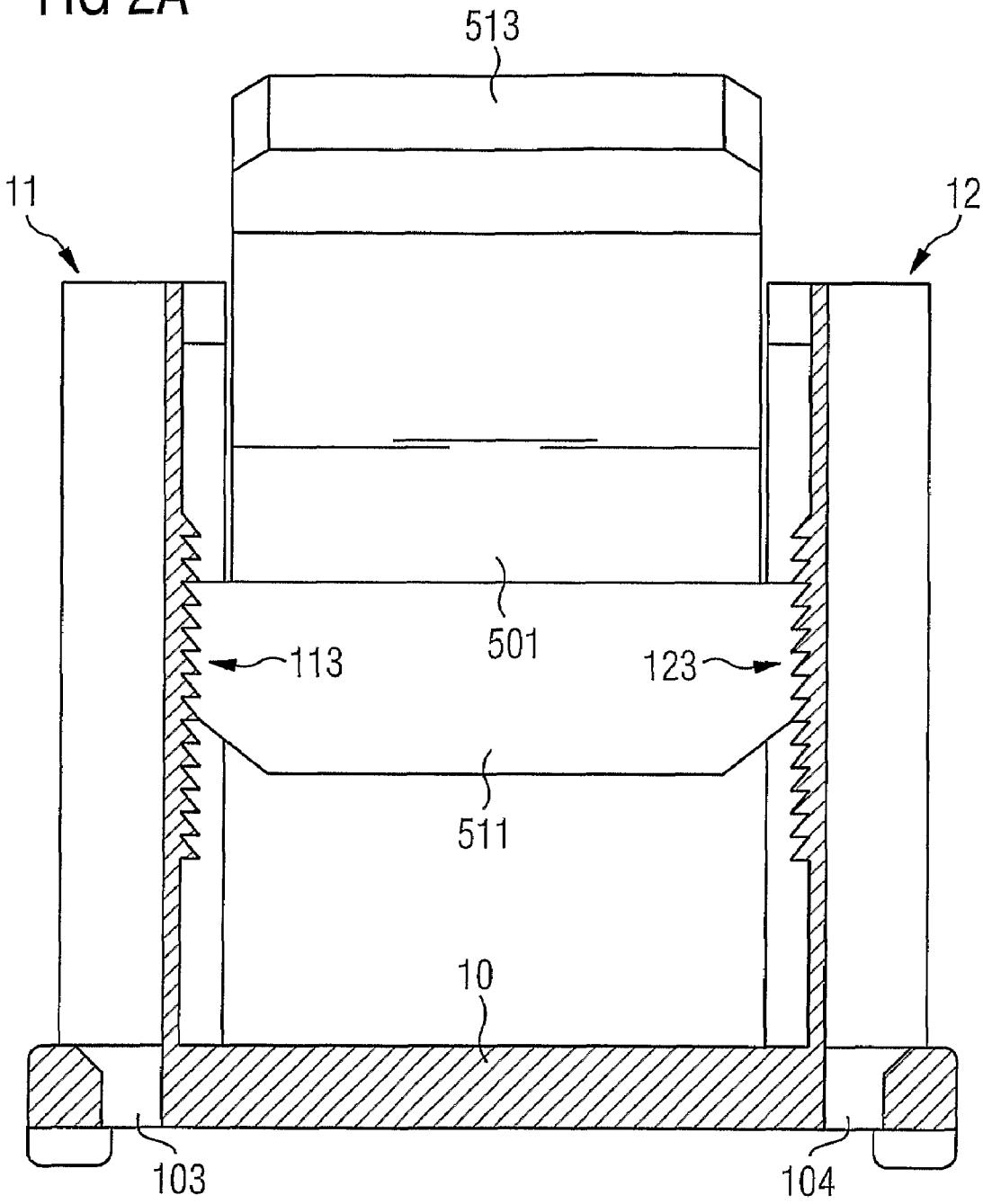
FIG. 2A, the mounting device according to FIGS. 1 and 2 after insertion of the potential separation device into the fixing device of the support device.

In FIG. 2A, the mount according to FIGS. 1 and 2 is shown after engagement of potential separation device 5 between fixing devices 11 and 12. The catch devices of a fixing device and the potential separation device are positively connected to one another. Catch devices 50, 113, 123 are formed as a ratchet lock, wherein the movement of potential separation device 5 upward is prevented by the preferred direction of the teeth.

Figure 4:
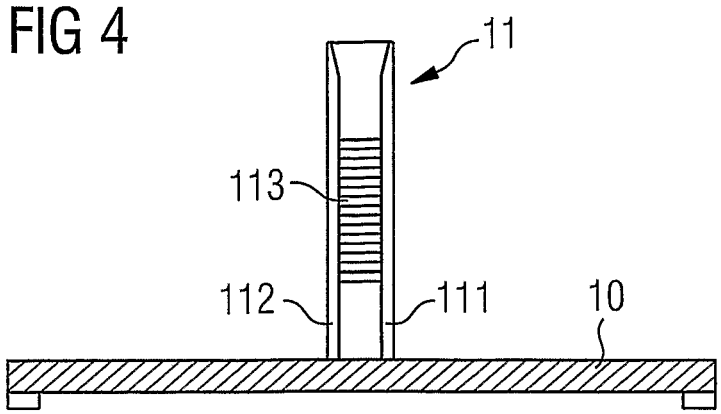
FIG. 4, a support device in a cross section parallel to the longitudinal direction of the base plate.
Figure 5:
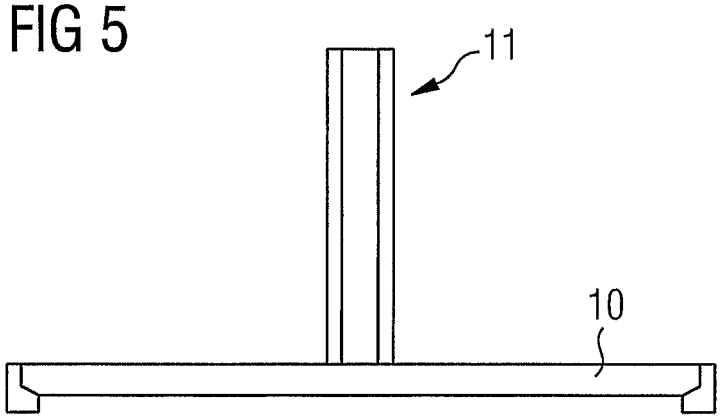
FIG. 5, a side view onto the support device according to FIGS. 1, 2, 2A and 4.
Figure 6:
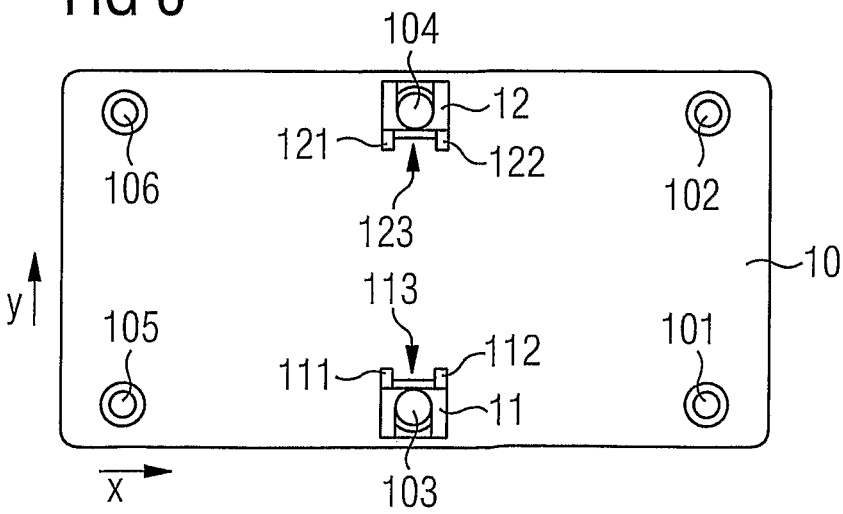
FIG. 6, the support device according to FIGS. 4 and 5 in a plan view from above.

An additional advantageous embodiment of a support device for a toroidal core choke is shown in FIGS. 4-6 in different views. Different views of a mount comprising this support device and a potential separation device 5 that can be inserted into a core hole are shown in FIGS. 7 to 9. The support device according to the second embodiment is preferably substantially identical to the support device formed according to the first embodiment, apart from the differences evident from the figures.

Fixing devices 11 and 12 are mirror-symmetrical in shape. Their design will be explained on the basis of fixing device 11.

FIG. 4 shows a partial cross-sectional view of the support device according to the second embodiment with a view onto fixing device 11 from the inside.

On its inner side facing the toroidal core hole, fixing device 11 has a catch device 113, constructed here as a ribbed catch surface. The ribbing runs along the axis of fixing device 11. The ribbing is formed in such a way that sliding a potential separation device 5 towards base plate 10 is possible, but sliding it in the direction opposite is prevented.

Catch device 113 is limited on both sides by rails 111 and 112. Rails 111 and 112 represent projections of fixing device 11 facing the toroidal core choke. These rails run parallel to the axis of the fixing device.

Tracks 111 and 112 are beveled towards the top side of the fixing device in such a manner that the introduction of a potential separating device 5 is facilitated.

The part of potential separating device 5 facing fixing device 11 is preferably formed in such a manner that it can slide between tracks 111, 112 without problems, but cannot slip laterally.

A side view of the support device according to FIG. 4 is shown in FIG. 5. The exterior of fixing device 11 can be seen.

It is shown in FIG. 6 that fixing devices 11, 12 each have substantially an H-profile.

Base plate 10 is subdivided in a longitudinal direction x into two edge areas and a central area. Fixing devices 11, 12 are arranged in the central area of base plate 10. Fixing devices 11, 12 face one another transverse to the longitudinal direction x of base plate 10. A choke area is provided between fixing devices 11, 12 for the accommodation of a toroidal core choke.

Two wire passage openings 101 and 102, 103 and 104, 105 and 106 provided for each respective area. Openings 101 to 106 are arranged in pairs along a transverse direction y. Each pair of openings serves to maintain the grid pattern of ends 31, 32, 33 of the respective wire winding 41, 42, 43 (shown, e.g., in FIGS. 3 and 9). Openings 101 and 102 serve for the passage of the two ends 32 of wire winding 42. Analogously, openings 103 and 104 serve for the passage of ends 33 of wire winding 43, and openings 105 and 106 for the passage of ends 31 of wire winding 41.

The wire guide channels of fixing devices 11 and 12 issue into openings 103 and 104, respectively.

The support device is preferably formed mirror-symmetrically relative to an axis running through its center, parallel to the x or y direction.

On the lower surface of the base plate 10, distancing feet 60 (FIG. 9) are arranged for maintaining a spacing between base plate 10 and a printed circuit board, not shown here, that is provided for mounting of the inductive component.

The end sections of wire winding 43 are fixed by the walls of fixing devices 11, 12. These end sections are preferably recessed into the respective wire guide channel, so that, in cross section on the open side of fixing devices 11, 12, the wire section does not project beyond these devices.

The end sections of wire winding 43 run in the wire guide channel and thus are fixed in the axial direction of the wire guide channel, i.e., perpendicular to base plate 10. Because end sections of wire winding 43 running transverse to base plate 10 are each fixed in the wire guide channel of the respective fixing device 11, 12, wherein they are prevented from slipping laterally, the position of the toroidal core choke relative to base plate 10 is likewise fixed.

Fixing devices 11, 12 each serve for an ensured spacing between wire ends 33 of wire winding 43 and the other wire windings 41, 42. Thus it is possible to use wire windings without an insulating sheath. Wire windings coated with an insulating lacquer, or even non-insulated wire windings can be used.

Fixing devices 11, 12 can have any cross section or a wire guide channel with any cross section. Fixing devices 11, 12 can be constructed as hollow tubes or hollow cylinders in one variant. The cross section of the wire guide channels is preferably matched to the shape of wire end 33.

Base plate 10 and its fixing devices 11, 12 are preferably produced in one piece, i.e., in one process step. It is also possible, however, to produce base plate 10 and fixing devices 11, 12 from a single material, or separately from different materials and to connect them solidly, preferably monolithically. It is also possible to provide base plate 10 first, and to produce fixing devices 11, 12 thereon in a later process step.

What is claimed is:

1. A mounting device insertable into a toroidal core of a choke, the mounting device comprising:

a center section;

at least two elastically deformable webs running outwards, windable around the center section, each deformable web having a rigid insulating area at its end turned away from the center section; and a catch device affixed adjacent the center section, wherein the mounting device can be fixed by means of catch devices on a counterpart component.

2. The mounting device according to claim 1, wherein the mounting device can be fixed in a toroidal core hole.

3. The mounting device according to claim 1, wherein the catch device is formed as a catch surface.

4. The mounting device according to claim 3, wherein the catch surface comprises a ribbing.

5. The mounting device according to claim 1, wherein the catch device is arranged on a face of the mounting device.

6. The mounting device according to claim 1, wherein the mounting device is provided as a potential separation device.

7. The mounting device according to claim 6, further comprising webs running in a star shape, wherein the catch device is affixed to at least one of the webs.

8. The mounting device according to claim 7, wherein the catch device is affixed to an insulating area.

9. The mounting device according to claim 1, wherein the catch device is affixed to the center section.

10. The mounting device according to claim 1, wherein the catch device includes catch surfaces projecting in relation to remaining parts of the mounting device.

11. The mounting device according to claim 1, in combination with the counterpart component, the counterpart component comprising a support device for a toroidal core, the support device having a catch device engaged with the catch device of the mounting device.

12. A support device for a toroidal core, the support device comprising a catch device for fixing a mounting device for the toroidal core.

13. The support device according to claim 12, wherein the catch device comprises at least one catch surface.

14. The support device according to claim 13, wherein catch device comprises two opposing catch surfaces.

15. The support device according to claim 12, in combination with a mounting device inserted into the toroidal core of a toroidal core choke.

16. The support device according to claim 15, wherein the support device forms at least a partial housing of an inductive component.

17. The support device according to claim 15, further comprising a base plate having projecting, elongated fixing devices and an area arranged therebetween for the accommodation of the toroidal core choke, wherein the fixing devices each have at least one catch surface facing the area.

18. The support device according to claim 17, wherein the fixing devices are each formed as a bar running perpendicular to the base plate.

19. The support device according to claim 17, wherein the fixing devices each have elongated projections, which limit catch surface laterally.

20. The support device according to claim 19, wherein ends of the fixing devices turned away from base plate are beveled.

21. The support device according to claim 17, wherein the fixing devices are provided for maintaining a pitch of a wire winding of the toroidal core choke.

22. The support device according to claim 17, wherein the fixing devices each have a wire guide channel.

23. The support device according to claim 22, wherein the wire guide channel runs transverse to the base plate.

24. The support device according to claim 22, wherein the wire guide channel is formed on a side of the fixing device turned away from a choke area.

25. The support device according to claim 17, further comprising an annular core choke arranged upright between the fixing devices.

26. The support device according to claim 17, wherein the fixing devices have an H-profile.

27. The support device according to claim 17, wherein at least two wire passage openings are provided in the base plate for the accommodation of ends of a wire winding.

28. The support device according to claim 27, wherein a wire guide channel of a mounting device issues into at least one wire passage opening.

29. A component comprising:

a support device comprising a catch device;

a mounting device insertable into a toroidal core of a choke, the mounting device comprising a center section, at least two elastically deformable webs running outwards, windable around the center section, each deformable web having a rigid insulating area at its end turned away from the center section; and a catch device affixed adjacent the center section, wherein the catch devices of the mounting device and the catch device of the support device are formed as counterparts to one another.

30. The component of claim 29, further comprising a toroidal core choke, which comprises a toroidal core and several wire windings around the toroidal core, wherein the mounting device is inserted into a core hole of the toroidal core choke and is fixed between fixing devices of the support device.

31. The component according to claim 30, wherein ends of the wire windings are passed through wire guide openings of a base plate.

32. The component according to claim 31, wherein ends of one of the wire windings are run in wire guide channels of the fixing devices.

* * * * *